US011800276B2

(12) United States Patent
Aniya et al.

(10) Patent No.: US 11,800,276 B2
(45) Date of Patent: Oct. 24, 2023

(54) SPEAKER DEVICE AND AUDIO DEVICE

(71) Applicant: Setuo Aniya, Hitaka (JP)

(72) Inventors: Setuo Aniya, Hitaka (JP); Shinichi Komori, Isehara (JP)

(73) Assignee: Setuo Aniya, Hitaka (JP)

( * ) Notice: Subject to any disclaimer, the term of this patent is extended or adjusted under 35 U.S.C. 154(b) by 20 days.

(21) Appl. No.: 17/637,638

(22) PCT Filed: Aug. 13, 2020

(86) PCT No.: PCT/JP2020/030775
§ 371 (c)(1),
(2) Date: Feb. 23, 2022

(87) PCT Pub. No.: WO2021/039420
PCT Pub. Date: Mar. 4, 2021

(65) Prior Publication Data

US 2022/0321993 A1 Oct. 6, 2022

(30) Foreign Application Priority Data

Aug. 23, 2019 (JP) ..... 2019-152748
Nov. 12, 2019 (JP) ..... 2019-204888

(51) Int. Cl.
*H04R 1/26* (2006.01)
*H04R 1/28* (2006.01)
*H04S 7/00* (2006.01)

(52) U.S. Cl.
CPC ..... *H04R 1/26* (2013.01); *H04R 1/288* (2013.01); *H04S 7/30* (2013.01)

(58) Field of Classification Search
CPC ..... H04R 1/26; H04R 1/288; H04S 7/30
See application file for complete search history.

(56) References Cited

U.S. PATENT DOCUMENTS 4,167,985 A * 9/1979 Dunlavy ..... H04R 1/323 181/146
5,511,129 A * 4/1996 Craven ..... H04S 7/307 381/103

(Continued)

FOREIGN PATENT DOCUMENTS

EP 0 898 364 B1 10/2003
JP 108-88893 A 4/1996

(Continued)

OTHER PUBLICATIONS

Nov. 2, 2020 International Search Report issued in International Patent Application No. PCT/JP2020/030775.

(Continued)

*Primary Examiner* — Jason R Kurr
(74) *Attorney, Agent, or Firm* — Oliff PLC

(57) ABSTRACT

An audio device uses a multi-way speaker device, an ideal state being when the virtual sound source points of each unit group overlap and the spherical surface of the wavefront of the sound output from each speaker unit group overlaps one spherical surface. In order for the virtual sound source points of each unit group to be close to each other so that the wavefront of the sound output from each unit group is approximated to one spherical surface. A positioning a placement position of the speaker unit group having relatively small diameters rearward from a viewing position with respect to a placement position of the speaker unit group having relatively large diameters, and/or making the number of speaker units constituting the speaker unit group having relatively small diameters larger than the number of speaker units constituting the speaker unit group having relatively large diameters is adopted.

7 Claims, 10 Drawing Sheets

(56) References Cited

U.S. PATENT DOCUMENTS

| | | | | |
|---|---|---|---|---|
| 10,805,715 | B2 * | 10/2020 | Alexander | H04R 1/26 |
| 2005/0169493 | A1 * | 8/2005 | Horbach | H04R 25/405 381/335 |
| 2013/0208916 | A1 * | 8/2013 | Debard | H04R 3/14 381/98 |
| 2017/0085990 | A1 | 3/2017 | Sladeczek et al. | |
| 2018/0255413 | A1 | 9/2018 | Aniya | |
| 2018/0338203 | A1 | 11/2018 | Alexander | |
| 2020/0014993 | A1 * | 1/2020 | Alexander | H04R 1/26 |

FOREIGN PATENT DOCUMENTS

| | | | |
|---|---|---|---|
| JP | H11-41681 | A | 2/1999 |
| JP | 2014-175883 | A | 9/2014 |
| JP | 2017-523654 | A | 8/2017 |
| WO | 02/078388 | A2 | 10/2002 |

OTHER PUBLICATIONS

Feb. 17, 2022 International Preliminary Report on Patentability issued in International Patent Application No. PCT/JP2020/030775.
Aug. 25, 2023 Extended Search Report issued in European Patent Application No. 20857826.0.

* cited by examiner

3 = Digital channel divider
4 = Preamplifier with sound field correction function
5 = Sound source (source)
21 = Low-pitched amplifier
22 = Mid-low pitched amplifier
23 = Mid-high pitched amplifier
24 = High-pitched amplifier 10 A-A' cut section

SPEAKER DEVICE AND AUDIO DEVICE

TECHNICAL FIELD

The present invention relates to a speaker device and an audio device capable of producing a sound close to a natural sound.

DESCRIPTION OF RELATED ART

As a speaker device in audio, first, there is a so-called single cone speaker system in which one speaker unit handles an entire frequency band. Further, there is also a multi-way speaker device in which a reproduction frequency range is divided into a plurality of frequency ranges and a reproduction of each frequency range is performed by a separate speaker unit.

The multi-way speaker device is configured so that a speaker having a relatively large diameter handles a relatively low frequency range, and a speaker having a relatively small diameter handles a relatively high frequency range. For example, a singer's voice includes sounds with a frequency of several hundred Hz to sounds with a frequency of several thousand Hz. When reproducing the sound of these wide range of frequencies on a multi-way speaker, the sound comes out of different speakers for each frequency range. Only when they are synthesized will it become the voice of a singer.

Here, sound can be represented by a wavefront of a three-dimensional curved surface (generally a spherical surface) that propagates through the air one after another. That is, it can be said that the sound propagating through the air is a physical quantity represented by a function of dimension 5 (variable 5). In contrast, the sound recorded on a source such as a CD is a waveform recording of the time change of a sound pressure (magnitude of change of air density) at a microphone point when the wavefront (sound) of this dimension 5 (variable 5) crosses the microphone one after another, the microphone being installed at one point. The sound recorded as a waveform in a source such as a CD is, so to speak, a physical quantity of dimension 2 (variable 2). By audio device, the waveform that is the physical quantity of the dimension 2 (variable 2) is amplified by an amplifier or the like to drive a speaker, then, the waveform is restored to the physical quantity represented by the function of dimension 5 (variable 5), that is, the sound propagating through the air.

PRIOR ART DOCUMENT

Patent Document

[Patent Document 1] Japanese Unexamined Patent Publication No. 2014-175883

SUMMARY OF THE INVENTION

Problems to be Solved by the Invention

For example, a wavefront (spherical surface) of the sound output from the mouth of a live singer is considered to be a spherical surface centered on one point, which is the mouth, regardless of frequency. That is, a singer's voice includes sounds with a frequency of several hundred Hz to sounds with a frequency of several thousand Hz.

Reproduction of a CD or the like, particularly on a multi-way speaker device will be considered, in which a waveform of a sound recorded with a voice of this singer is engraved. Then, it is found that in the multi-way speaker device, sound with a relatively low frequency is output from a speaker unit having a relatively large diameter, and sound with a relatively high frequency is output from a speaker unit having a small diameter.

Here, the sound output from the speaker unit is also a wavefront of a three-dimensional curved surface that propagates through the air one after another. In this case, it is considered that generally the wavefront of the sound output from the speaker unit can be approximated to a spherical surface. That is, the wavefront can be approximated to the spherical surface when the spherical surface is the surface centered on a virtual sound source point that is considered to be rearward from a diaphragm of the speaker unit. Further, in the conventional multi-way speaker, generally, the diaphragm of the speaker unit having a large diameter and the diaphragm of the speaker unit having a small diameter are placed at the same distance from a viewing position. In such a case, the wavefront of the sound output from the speaker unit having a large diameter and the wavefront of the sound output from the speaker unit having a small diameter, will be considered. When the wavefront of those sounds touches a certain surface (for example, a vertical plane containing the viewing point), a radius of curvature of the wavefront of each sound at that time will be considered. Then, it can be considered that the radius of curvature of the wave front (spherical surface) of the sound output from the speaker unit having a large diameter is larger than the radius of curvature of the wave front (spherical surface) of the sound output from the speaker unit having a small diameter.

Then, when the above-described singer's voice is reproduced by the multi-way speaker device, a low-frequency sound component and a high-frequency sound component of the sound components of the singer's voice, have different radii of curvature of the wave front (spherical surface) of the sound when they touch a certain surface. In other words, a virtual pronunciation point of the singer's voice differs depending on a frequency component.

The phenomenon that the pronunciation point of the singer's voice differs depending on the frequency component is considered to be an unnatural phenomenon that is hard to imagine in the natural world. Further, in the first place, according to a research by the present inventor, the voice of the singer is detected and recorded at one point (one point each on the left and right in stereo). It is considered that information recorded at one point is reproduced with a sound different from an original recorded sound, unless it is output from a sounding body using one point as a virtual sound source point. From that point of view, the phenomenon that the sounding point differs depending on the frequency component is considered to be undesirable from a viewpoint of faithful reproduction.

Further, all sounds such as music are recorded as waveforms in a source such as a CD. Accordingly, faithful reproduction in audio is considered to be the production of sound that faithfully reproduces this music waveform from a speaker or the like. However, it is known by the investigation of the present inventor, that in a current audio device, when a waveform recorded on a source such as a CD reproduced by a speaker, detected by a microphone, and recorded again, and a waveform of a source such as the above original CD are compared, the degree of coincidence of the waveforms is a cross-correlation value of about 0.6 to 0.7 (waveform reproducibility is about 60 to 70%). It seems that this cannot be said to be faithful reproduction at all.

The present invention has been made to solve the above-described problem, and an object of the present invention is to provide a speaker device and an audio device that can produce sound that is more natural and faithful to the source.

Means for Solving the Problem

The means for solving the above-described problem is as follows.

(1)

A speaker device configured such that:

a reproduction frequency range is divided into a plurality of frequency ranges, and a reproduction of each frequency range is handled by a speaker unit group composed of one or more speaker units;

the speaker unit group that handles a relatively low frequency range is composed of speaker units having relatively large diameters; and the speaker unit group that handles a relatively high frequency range is composed of speaker units having relatively small diameters, wherein the speaker unit group is a multi-way speaker device that allows one or more speaker units to be regarded as a unit that virtually outputs sound in a frequency range that one speaker handles, and based on a recognition that a wavefront of the sound output from the speaker unit group is approximated to a spherical surface centered on a virtual sound source point of each unit group, and an ideal state is when the virtual sound source points of each unit group overlap and the spherical surface of the wavefront of the sound output from each speaker unit group overlaps one spherical surface, and in order for the virtual sound source points of each unit group to be close to each other so that the wavefront of the sound output from each unit group is approximated to one spherical surface, either one or both configurations are adopted, out of a configuration in which a placement position of the speaker unit group having relatively small diameters is positioned rearward from a viewing position with respect to a placement position of the speaker unit group having relatively large diameters, or a configuration in which the number of speaker units constituting the speaker unit group having relatively small diameters is larger than the number of speaker units constituting the speaker unit group having relatively large diameters.

(2)

The speaker device according to (1), wherein the unit groups are placed so that the virtual sound source points of each of the unit groups are on a common plane.

(3)

The speaker device according to (1) or (2), wherein when a diaphragm of the speaker unit or the speaker unit group is approximated to one circle, and a diameter of the circle is 2L, a radius of the wavefront of the sound output from the unit is D, and a position of the virtual sound source point is at a distance A rearward from the diaphragm on a central axis of the diaphragm, the virtual sound source point of each speaker unit or speaker unit group is obtained by a formula, with a value of A set as $A=L+(L\times L\div 2D)$.

(4)

The speaker device according to (3), wherein a placement position of the speaker unit group having relatively small diameters that output relatively high frequency sound is set at AL-AH distance rearward from a listening position with respect to a placement position of the speaker unit group having relatively large diameters that output relatively low frequency sound, wherein AL is a distance from a diaphragm to the virtual sound source point when the diaphragm of the speaker unit group having relatively large diameters that output relatively low frequency sound is approximated to one circular diaphragm, and AH is a distance from the diaphragm to the virtual sound source point when the diaphragm of the speaker unit group having relatively small diameters that output relatively high frequency sound is approximated to one circular diaphragm.

(5)

The speaker device according to any one of (1) to (4), wherein the speaker units constituting the speaker unit group that handles each frequency range can handle a sound in this frequency range by themselves, and in the frequency range that each single speaker unit handles, a sound in the frequency range that is handled by each single speaker unit, is outputted by a piston movement so that cone paper does not cause split vibration.

(6)

The speaker device according to any one of (1) to (5), wherein a sound absorbing member for absorbing noise generated from a surface of a speaker box to which the speaker unit is attached, is provided on a main surface of the speaker box.

(7)

An audio device, including:

a channel divider device that divides an input sound signal into multiple frequency ranges and outputs it;

a plurality of amplification devices that input sound signals output from the channel divider device, amplify them, and output them;

a multi-way speaker device that inputs the outputs of the plurality of amplification devices to different speaker units that handle reproduction in each frequency range and reproduces them, and a digital correction device that corrects group delay characteristics and frequency characteristics of the audio device, wherein the speaker device is the speaker device according to any one of (1) to (6).

(8)

The audio device according to (7), wherein the correction device has a correction algorithm created based on impulse response characteristics obtained by placing a measurement microphone at a measurement position installed in a range of 10 cm to 100 cm from the speaker device, and this correction algorithm is an algorithm that corrects frequency characteristics and group delay characteristics so that the frequency characteristics and the group delay characteristics become almost ideal characteristics in a reproduction frequency range planned by this audio device, accordingly, when this audio device records music on a source such as a CD, reproduces the music, detects and records the reproduced sound with a microphone installed at the measurement position, and a recorded music waveform is compared with a music waveform recorded on a source such as an original CD, both waveforms almost match.

Advantage of the Invention

According to the above-described means (1) to (6), the wavefront of the sound output from each speaker unit group can be approximated to one spherical surface. Further, according to the means of (6), the sound (noise) from other than the cone paper of the speaker can be significantly reduced. When the speaker device of (1) to (6) is corrected by the means of (8), the speaker device can output a sound in which the waveform is reproduced and at the same time the wavefront matches (meaning closer to match). That is, a difference in a distance between the speaker units from the listening position is also automatically corrected by the correction. In this way, it is confirmed that the sound in which the waveform is reproduced and at the same time the wavefront matches, is a sound that is completely different from the sound output from a conventional speaker, for which such a thing was never considered, and it's a really lively and attractive sound, as if all plating and veil are stripped off.

BRIEF DESCRIPTION OF THE DRAWINGS

FIG. 9 is an explanatory view of a method for obtaining a virtual sound source point of a mid-high pitched speaker unit MH1 or the like.

DETAILED DESCRIPTION OF THE INVENTION (Audio Device According to an Embodiment)

Figure 1:
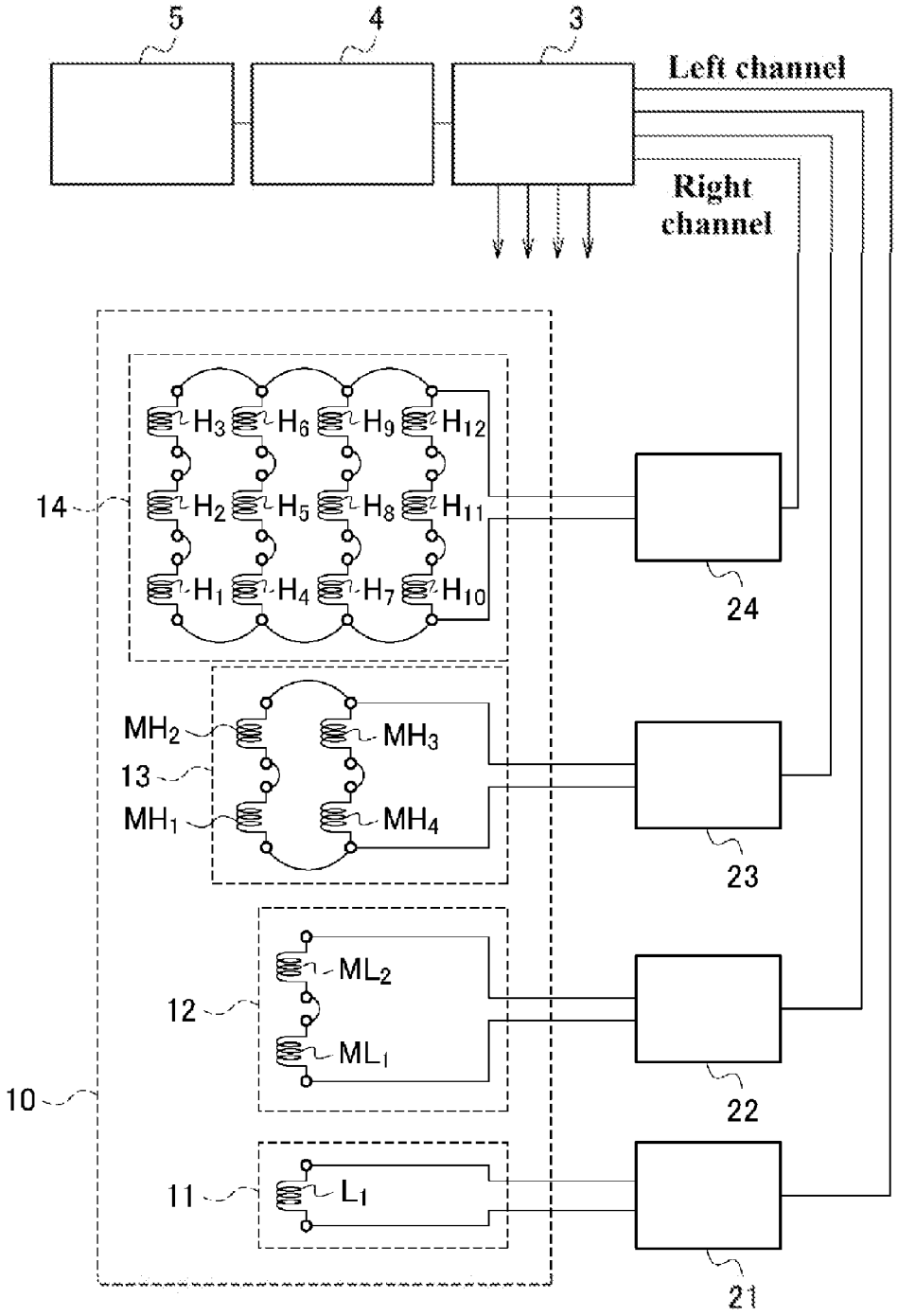
FIG. 1 is a view illustrating an overall configuration of an audio device according to an embodiment of the present invention.
Figure 2:
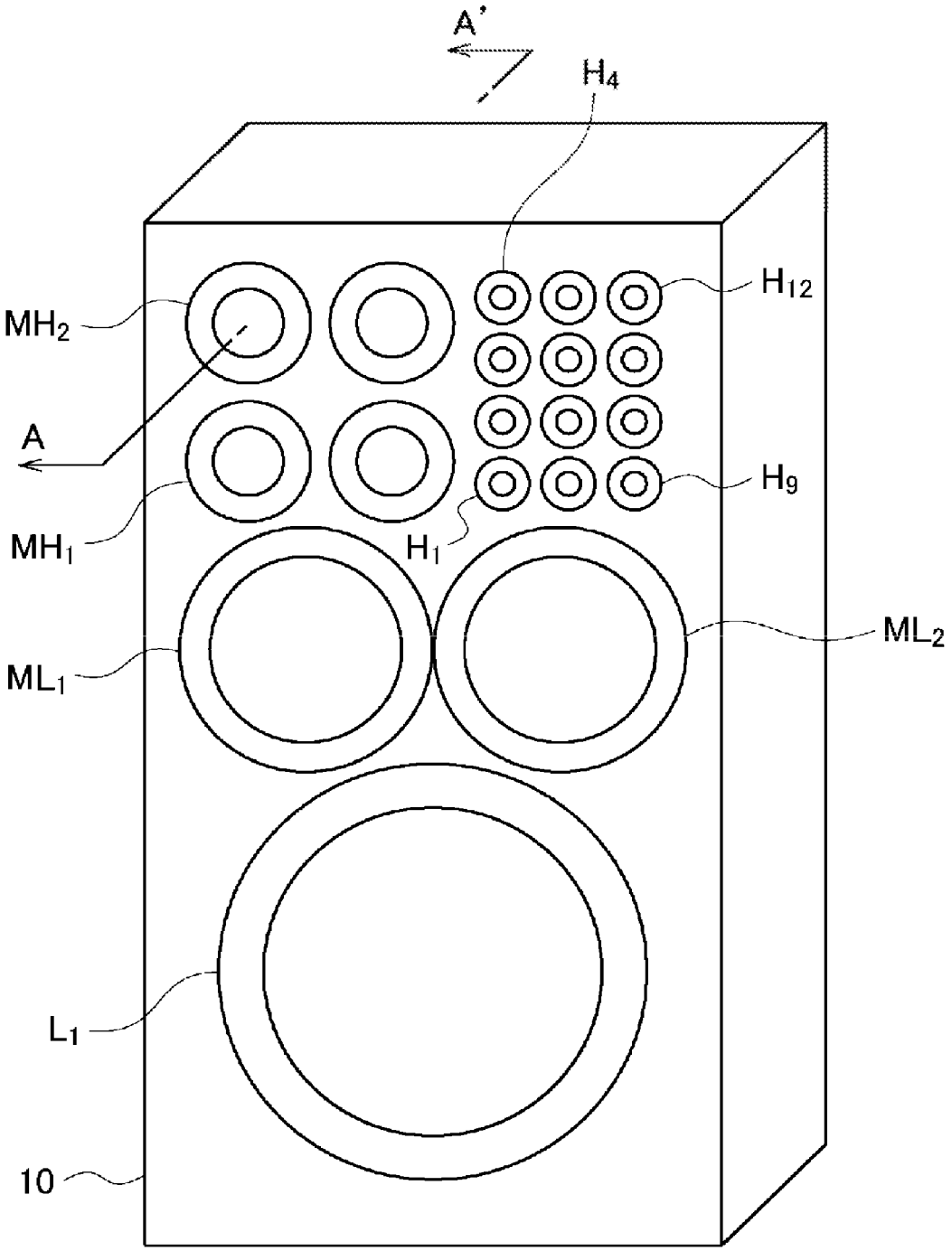
FIG. 2 is an external configuration view of a speaker device 10 according to an embodiment of the present invention.
Figure 3:
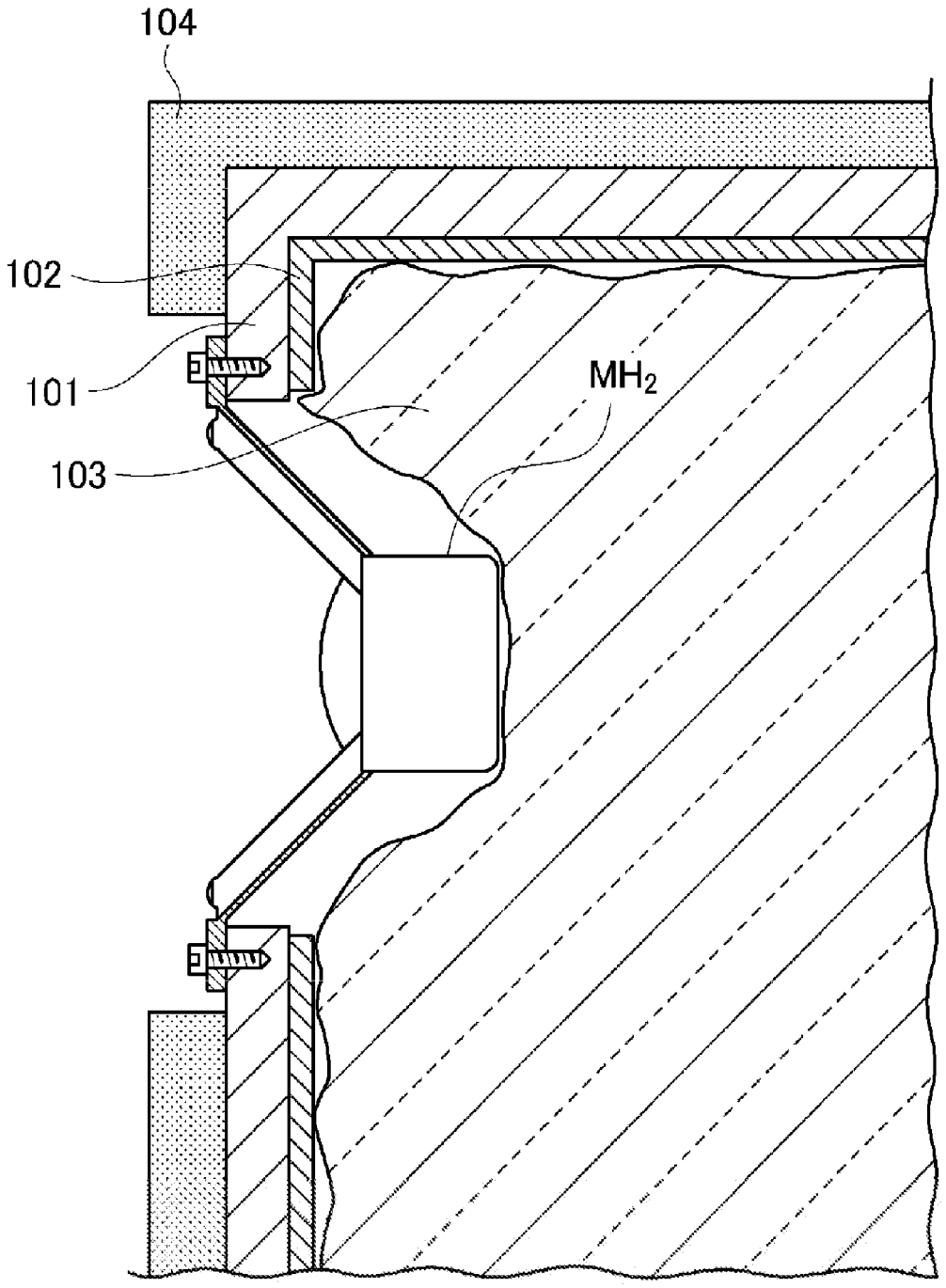
FIG. 3 is a partial cross-sectional view taken along the A-A' line of the speaker device 10 according to the embodiment of the present invention illustrated in FIG. 2.

FIG. 1 is a view illustrating a configuration of an audio device according to an embodiment of the present invention, and FIG. 2 is an external configuration view of a speaker device 10, and FIG. 3 is a partial cross-sectional view taken along the line A-A' of the speaker device 10.

As illustrated in these views, the audio device according to the embodiment is composed of a speaker device 10; a low-pitched amplifier 21 for driving the speaker unit provided in the speaker device 10; a mid-low pitched amplifier 22; a mid-high pitched amplifier 23; a high-pitched amplifier 24; a channel divider 3 that sends a low-pitched signal, a mid-low pitched signal, a mid-high pitched signal, and a high-pitched signal to these amplifiers; a preamplifier 4 with a sound field correction function that sends a sound signal to this channel divider 3; and a sound source device 5 that sends a sound signal to the preamplifier 4.

The speaker device 10 includes: a low-pitched speaker unit group 11 that handles a low sound range; a mid-low pitched speaker unit group 12 that handles a mid-low sound range; a mid-high pitched speaker unit group 13 that handles a mid-high pitched sound range; and a high-pitched speaker unit group 143 that handles a high-pitched sound range.

The low-pitched speaker unit group 11 that handles a low-pitched sound range is composed of one large-diameter low-pitched speaker L1. This low-pitched speaker unit L1 has a diameter of about 40 cm and handles a frequency range in a range of 25 Hz to 70 Hz. Further, the mid-low pitched speaker unit group 12 that handles a mid-low pitched sound range is composed of two mid-low pitched speaker units ML1 and ML2. These mid-low pitched speaker units ML1 and ML2 have diameters of about 13 cm and handle a frequency range in a range of 70 Hz to 650 Hz. These two speaker units ML1 and ML2 are appropriately connected in series or in parallel depending on a resistance of a voice coil.

The mid-high pitched speaker unit group 13 that handles a mid-high pitched sound range is composed of four mid-high pitched speaker units MH1 to MH4. These mid-high pitched speaker units MH1 to MH4 have diameters of about 5 cm and handle a frequency range in a range of 650 Hz to 1700 Hz. In these four speaker units MH1 to MH4, two connected in series are connected in parallel.

Further, the high-pitched speaker unit group 14 that handles a high-pitched sound range is composed of twelve high-pitched speaker units H1 to H12. The high-pitched speaker units H1 to H12 have diameters of about 1 cm and handle a frequency range in a range of 1700 Hz to 20000 Hz. In these 12 speaker units H1 to H12, four sets of three connected in series are connected in parallel.

Two mid-low pitched speaker units ML1 and ML2 constitute the mid-low-pitched speaker unit group 13, four mid-high pitched speaker units MH1 to MH4 constitute the mid-high pitched speaker unit group 12, and twelve high-pitched speaker units constitute the high-pitched speaker unit group. Even one of them can reproduce the frequency range that it handles. Then, it is desirable to use one that can reproduce almost an entire frequency range that it handles by piston motion without causing so-called split vibration. Further, the speaker units constituting these speaker unit groups are installed as close as possible to each other. Thereby, multiple speaker units are integrated so that they can be regarded as virtually one speaker unit outputting sound. In addition, all speaker units are also installed as close as possible to each other. Thereby, a group of multiple speaker units are integrated so that sound can be virtually regarded as being output from one speaker unit. Thereby, a correction described later can be ideally applied, thereby enabling a waveform reproduction described later is possible.

As illustrated in FIG. 2, the speaker device 10 is composed of a box body 101 with a rectangular parallelepiped shape, a vibration damping sheet 102 attached to an inner surface of this box body 101, a sound absorbing member 103 filled inside the box body 101, and a sound absorbing panel 104 attached so as to cover an outer surface of the box body 101. The box body 101 is made of a material that does not easily vibrate, such as a metal aluminum plate or hard wood. The vibration damping sheet 102 is composed of a lead plate and other vibration damping members. The sound absorbing member 103 is made of cotton, rock wool, urethane foam, or the like having a high sound absorbing performance. The sound absorbing panel 104 is composed of a sound absorbing panel made of a material such as sound absorbing urethane or rock wool in the form of a panel. Thereby, the sound (noise) output from the surface of the box body 101 due to the vibration of the cone paper of each speaker unit and the sound (noise) reflected inside of the box body 101 penetrating the cone paper can be prevented from being released to outside.

The low-pitched amplifier 21, the mid-low pitched amplifier 22, the mid-high pitched amplifier 23, and the high-pitched amplifier 24 are power amplification amplifiers, respectively, and a sound signal from the channel divider 3 is power-amplified to drive the low-pitched speaker unit group 11, the mid-low pitched speaker unit group 12, the mid-high pitched speaker unit group 13, and the high-pitched speaker unit group, respectively.

The channel divider 3 divides the sound signal sent from the preamplifier 4 into sound signals in the low-pitched, mid-low pitched, mid-high pitched, and high-pitched sounds frequency ranges, and sends the sound signal to the low-pitched amplifier 21, the mid-low pitched amplifier 22, the mid-high pitched amplifier 23 and the high-pitched amplifier 24. The channel divider 3 is composed of a large number of digital filters such as an FIR filter or an IIR filter. This is because an analog channel divider in which resistors, capacitors, etc. are used, is not preferable because this channel divider causes group delay that is harmful to waveform reproduction. The channel dividers in which a large number of digital filters such as FIR filters or IIR filters are used, can be configured by using a computer device programmed to operate a large number of digital filters such as FIR filters or IIR filters so as to be operated as channel dividers. If possible, it is desirable to use the FIR filters with good phase characteristics. The number of taps on the filter should be several thousand or more, and if possible, around 100,000.

The preamplifier 4 with a sound field correction function includes an amplifier that amplifies the sound signal sent from the sound source 5, and also includes a computer device that executes sound field correction processing. Here, the sound field correction is at least a correction for correcting group delay characteristics and the frequency characteristics.

Group delay correction and frequency correction are applied using a digital filter such as a well-known FIR filter. According to this filter, the correction can be applied relatively easily without causing a phase disturbance or the like.

Here, again, the number of taps on the filter should be several thousand or more, and if possible, around 100,000. As is generally used in well-known AV amplifiers, an impulse response measurement signal for measuring the group delay characteristics and the frequency characteristics is reproduced by an audio device, then, the reproduced impulse response measurement signal is received with a microphone and analyzed, and an acoustic transfer function is prepared for reverse-correcting the obtained group delay characteristics and frequency characteristics, and using this acoustic transfer function, the correction can be applied and realized by a built-in computer device in the preamplifier 4, the computer device being programmed to perform the above processing.

In the correction, for example, a correction algorithm is prepared based on the impulse response characteristics obtained by placing the measurement microphone at a position close to the speaker unit group that reproduces the high-pitched sound range, that is, at a measurement position set on a virtual axis of this speaker device 10, that is, at a short distance of about 25 cm from the front of the speaker device 10. This correction algorithm is an algorithm that corrects the frequency characteristics and the group delay characteristics so that the frequency characteristics and the group delay characteristics become almost ideal characteristics in the reproduction frequency range planned by this audio device. Accordingly, when this audio device is recorded on a source such as a CD and plays music, then, the reproduced sound is detected and recorded by a microphone installed at the measurement position and the recorded music waveform is compared with the music waveform recorded on the source such as an original CD, both waveforms almost match. That is, it enables "waveform reproduction" in which the music waveform engraved on the source is reproduced by a speaker.

In the audio device according to the present embodiment, an astonishing value is obtained, such that when the waveform recorded on a source such as a CD is reproduced by a speaker, detected by a microphone, and recorded again, and the waveform of the source such as the above-described original CD, are compared, the degree of coincidence of the waveform is a cross-correlation value of 0.99 or more (waveform reproducibility is 99% or more). It is desirable that the music waveform used here is an orchestra song or an opera song as much as possible, in which sounds of a wide range of frequencies are contained and many types of instruments and voices such as stringed instruments and percussion instruments are recorded. Here, all waveforms of the song Mambo Italiano (a song of about 2 minutes) are compared, in which Rosemary Clooney is in charge of vocals. Further, the measurement position may be in a range of 10 cm to 100 cm from the front of the speaker device 10. This is because with this distance, even in a normal room, an influence of reflected sound is small, and almost correct impulse response characteristics can be measured. However, when this measurement is performed in an anechoic chamber, the measurement position may be farther away from the speaker device.

As described above, the correction is decisively different from a conventional concept of sound field correction. That is, the conventional sound field correction attempts to optimize an acoustic transfer function at a listening position by placing a microphone at the listening position. In contrast, the correction of the present invention is the correction in which at a position as close as possible to a speaker, within a range where multiple speaker units can be virtually regarded as one speaker as a unit, the frequency characteristics and the group delay characteristics are made ideal on a virtual axis of this speaker.

Further, the speaker device of the present embodiment is decisively different from a conventional speaker device. That is, in the conventional speaker device, a desired sound is obtained by resonating the sound of the speaker unit with a box, a cylinder, a horn, or the like. In contrast, the speaker device of the present embodiment is decisively different in that it does not resonate with a box, a cylinder, a horn, or the like. Thereby, the sound outputs from only the cone paper that vibrates depending on a signal, and all other sounds are removed as noise. Then, correction is applied at a position close to the speaker. As a result, an impulse response measurement that is a basis of the correction can be an accurate measurement without noise, and this makes it possible to perform ideal correction and reproduce the above-described waveform.

In contrast, with a conventional speaker device, it is impossible to measure correct impulse response characteristics even when it is measured at a position close to the speaker, due to noise from the box of the speaker device. In addition, since a measurement was performed at a listening position, the measurement was more inaccurate due to an influence of a reflected sound in a room. As a result of applying correction based on such an inaccurate impulse response measurement, a result far from ideal characteristics was obtained. As a result, when a music waveform obtained by reproducing music recorded on the source such as a CD using a conventional audio device and detecting and recording the reproduced sound using a microphone installed at the measurement position, and a music waveform recorded on the source such as an original CD, were compared, there was a considerable difference between the two waveforms (waveform reproducibility was 60 to 70%).

A sound source device 5 that sends a sound signal is a device that reads out a sound signal of a recording medium on which a digital or analog sound signal such as a well-known CD player or record player is recorded, converts it into a predetermined signal, and sends it to the preamplifier 4.

Figure 4:
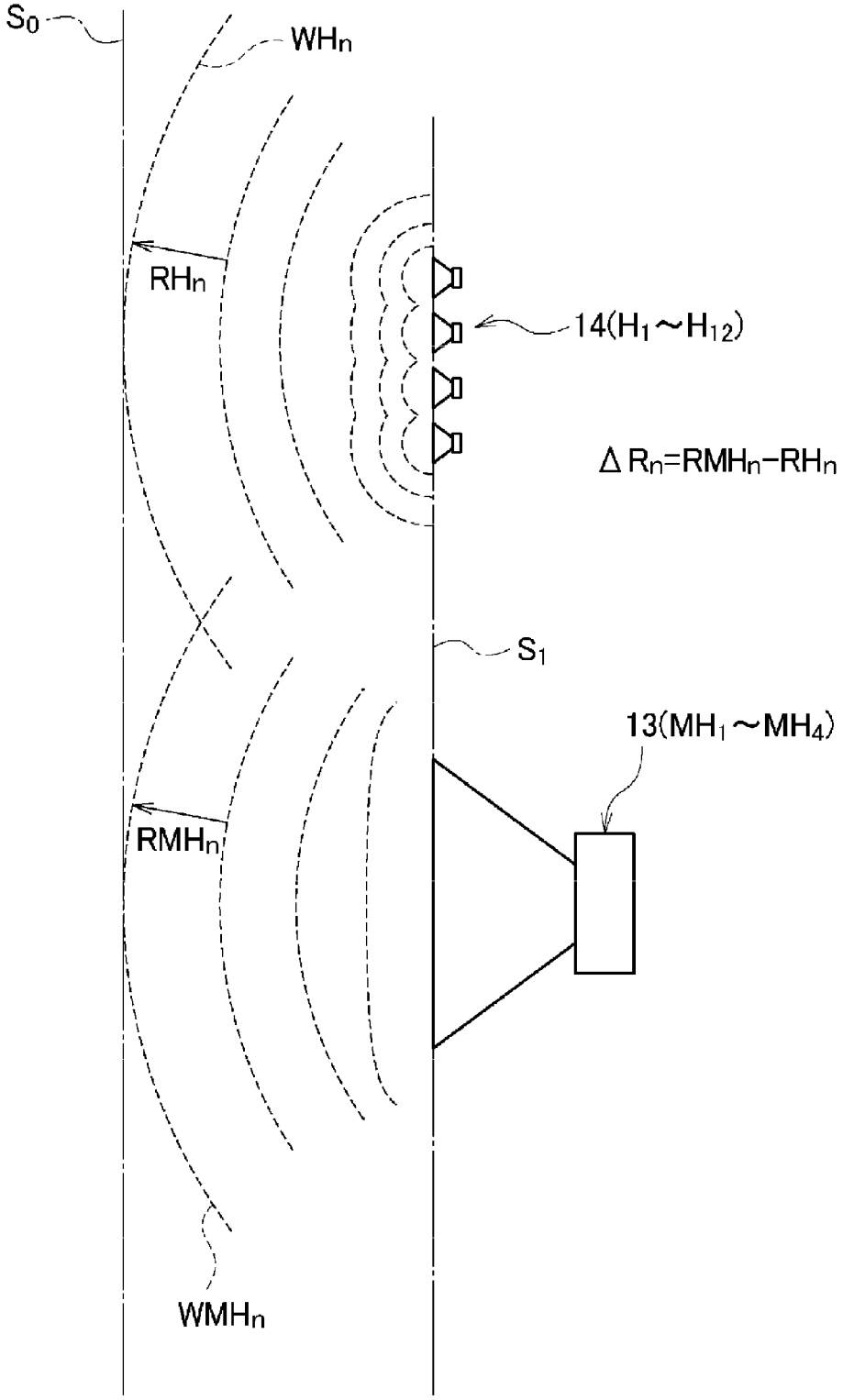
FIG. 4 is an image view of a sound wavefront WHn reproduced by a high-pitched speaker unit group 14 of the speaker device 10 and a sound wavefront WMHn reproduced by a mid-high-pitched speaker unit group 13.

FIG. 4 is an image view of the wavefront WHn of the sound reproduced by the high-pitched speaker unit group 14 of the speaker device 10 and the wavefront WMHn of the sound reproduced by the mid-high-pitched speaker unit group 13. In FIG. 4, the high-pitched speaker unit group 14 is shown by four high-pitched speaker units. However, the high-pitched speaker unit group 14 is actually composed of twelve high-pitched speakers H1 to H12, and this is omitted in the figure. Further, the mid-high pitched speaker unit group 13 is shown by one mid-high pitched speaker unit. However, the mid-high pitched speaker unit group 13 is actually composed of four mid-high pitched speakers MH1 to MH4. Both the wavefront WHn and wavefront WMHn can be approximated to a spherical surface.

As illustrated in FIG. 4, a speaker unit mounting surface of the speaker device 10 is S1, and a surface parallel to S1 is a reference surface S0, this surface being set at a position 25 cm away from the surface S1 in a front direction of the speaker device. In this case, a radius of curvature is RMHn and RHn, the radius of curvature being the curvature when both the wavefront WMHn and the wavefront WHn are in contact with the reference plane S0. Then, a difference between the radii of curvature RMHn and RHn of those wavefronts is ΔRn.

Figure 5:
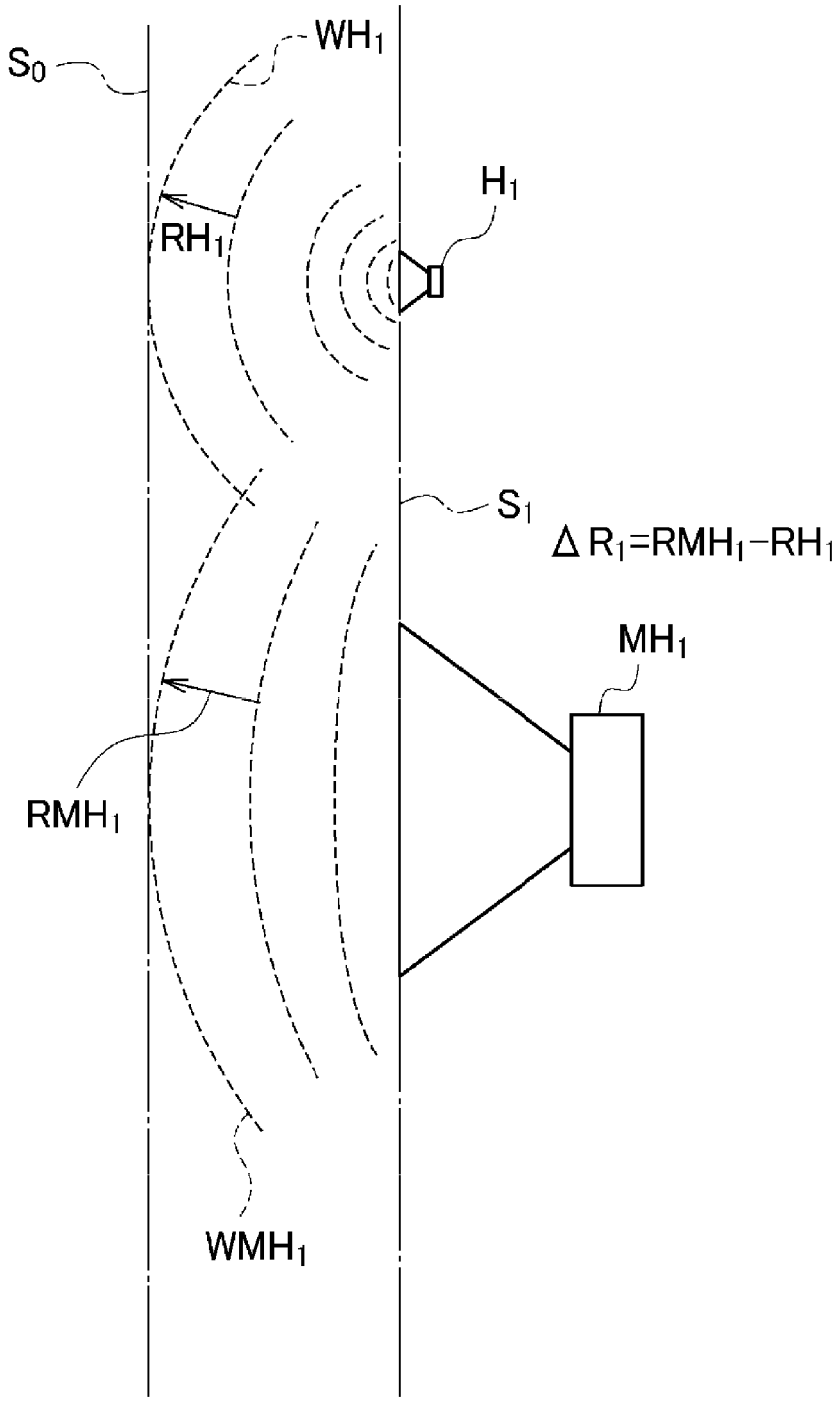
FIG. 5 is an image view of a wavefront WMH1 by a mid-high pitched speaker unit MH1 and a wavefront WH1 by a high-pitched speaker unit H1.

On the other hand, when it is assumed that the mid-high pitched speaker unit group 13 is composed of only one mid-high pitched speaker unit MH1, and the high-pitched speaker unit 14 is composed of only one high-pitched speaker unit H1, FIG. 5 is an image view of the wavefront WMH1 using the mid-high pitched speaker unit MH1 and the wavefront WH1 using the high-pitched speaker unit H1. In FIG. 5, as in the case of FIG. 4, the speaker unit mounting surface of the speaker device 10 is S1, and the plane parallel to S1 set at a position 25 cm away from this plane S1 in the front direction of the speaker device, is the reference plane S0. In this case, the radius of curvature is RMH1 and RH1, respectively, the radius of curvature being the curvature when the wavefront WMH1 and the wavefront WH1 both in contact with the reference plane S0. Then, a difference between the radii of curvature RMH1 and RH1 of those wavefronts is ΔR1.

Figure 6:
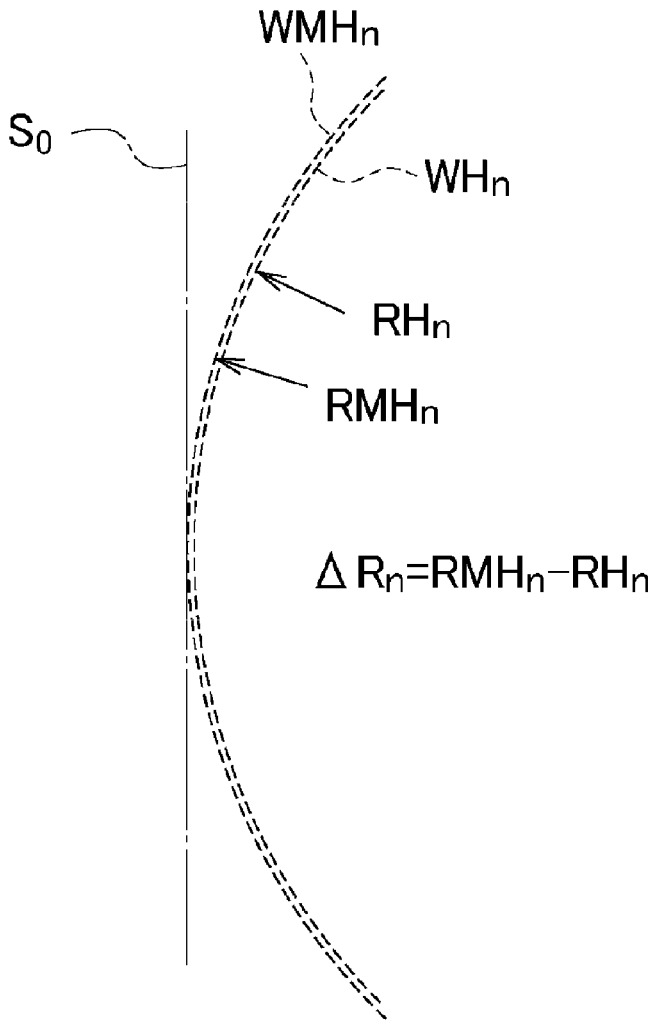
FIG. 6 is a view in which a difference ΔRn in a radius of curvature between the wavefront WMHn and the wavefront WHn can be easily understood.
Figure 7:
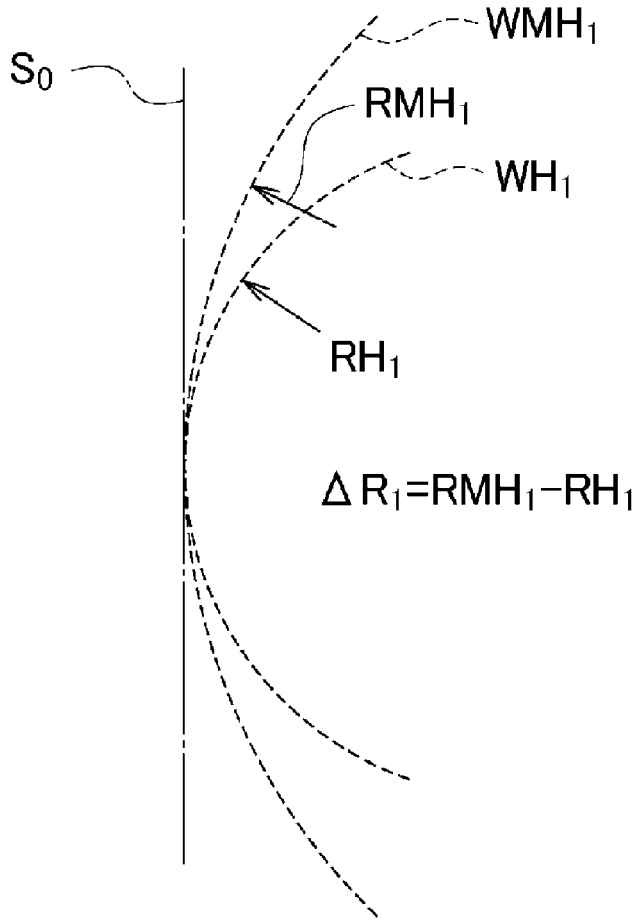
FIG. 7 is a view in which a difference ΔR1 in a radius of curvature between the wavefront WMH1 and the wavefront WH1 can be easily understood.

FIG. 6 is a view in which the difference ΔRn in the radius of curvature between the wavefront WMHn and the wavefront WHn can be easily understood, and FIG. 7 is a view in which the difference ΔR1 in the radius of curvature between the wavefront WMH1 and the wavefront WH1 can be easily understood. As is clear from these figures, the difference between the radius of curvature RMHn of the wavefront WMHn composed of MHn (MH1+ . . . +MH4) using four mid-high pitched speaker units having relatively large diameters, and the radius of curvature RHn of the wavefront WHn composed of Hn (H1+ . . . +H12) using 12 high-pitched speaker units having relatively small diameters, is almost equal to zero. In contrast, it is found that the difference ΔR1 between radius of curvature RMH1 of the wavefront WMH1 composed of MH1 using one mid-high pitched speaker unit having a relatively large diameter, and radius of curvature RH1 of the wavefront WH1 composed of H1 using one high-pitched speaker unit having a relatively small diameter, is clearly much larger than zero.

The above description also applies to a relationship between the mid-high pitched speaker unit group 13 and the mid-low pitched speaker unit group 12, and applies to a relationship between the mid-low pitched speaker unit group 12 and the low-pitched speaker unit group 11. That is, in order to reduce the difference between the radius of curvature of the wavefront using the speaker unit having a large diameter and the radius of curvature of the wavefront using the speaker unit having a small diameter, the number of speaker units having small diameters may be larger than the number of speaker units having large diameters.

For the relationship between the number of units having large diameters and the number of units having small diameters, for example, the relationship of the number is temporarily determined by reference to a value of a ratio of a size of the diameter or a value of a ratio of an area of the cone paper. Then, listening is tried based on the relationship of the number, then, the number of units is increased or decreased, the listening is further tried, and the relationship of an audibly optimum number is determined. For example, in a unit having a diameter of 5 cm and a unit having a diameter of 1 cm, first, listening is tried using five units having diameters of 1 cm with respect to one unit having a diameter of 5 cm. Next, listening is tried by increasing the number of units having diameters of 1 cm to four or six, and the number that seems to be most audibly preferable is obtained.

A more accurate number can be obtained by regarding multiple units as one speaker and finding virtual sound source points thereof. It can be considered that the more accurate number can be obtained, for example, by a technique of adding a pulse signal to a group of multiple units that are regarded as one unit, then, measuring a sound that is outputted at a certain point, and obtaining one after another the time observed at the measurement point and a point where a pulse sound can be observed at the same time, to identify the wavefront and obtain the center of the wavefront. When the virtual sound source point is obtained in this way, the virtual sound source points of each speaker unit are placed so that they are on the same plane, and the unit group is placed so that the virtual sound source points are as close as possible to each other on the plane. Ideally, the virtual sound source points should match. With such a technique, the wavefronts of the sounds output from each unit group are completely matched, and an epoch-making sound quality improvement effect can be obtained.

According to the audio device of the above-described embodiment, it is possible to make the radius of curvature of the wavefront almost constant regardless of the frequency, and to make the wavefronts match each other as much as possible, that is, to get closer to "creating an ideal wavefront", then more natural sound can be reproduced, compared to a conventional audio device involving a problem such that the radius of curvature of the wavefront of the sound output from the speaker device 10 differs greatly depending on the frequency, and the wavefronts of each other may be separated from each other. In addition, according to the audio device of the present embodiment, ideal correction can be applied, thereby enabling "waveform reproduction" for the music waveform engraved on the source. The audio device according to the present embodiment is epoch-making different from the conventional audio device in these two points, that is, "ideal wavefront creation" and "waveform reproduction". Accordingly, the reproduced sound is a revolutionary sound of a different dimension from the reproduced sound of the conventional audio device.

Figure 8:
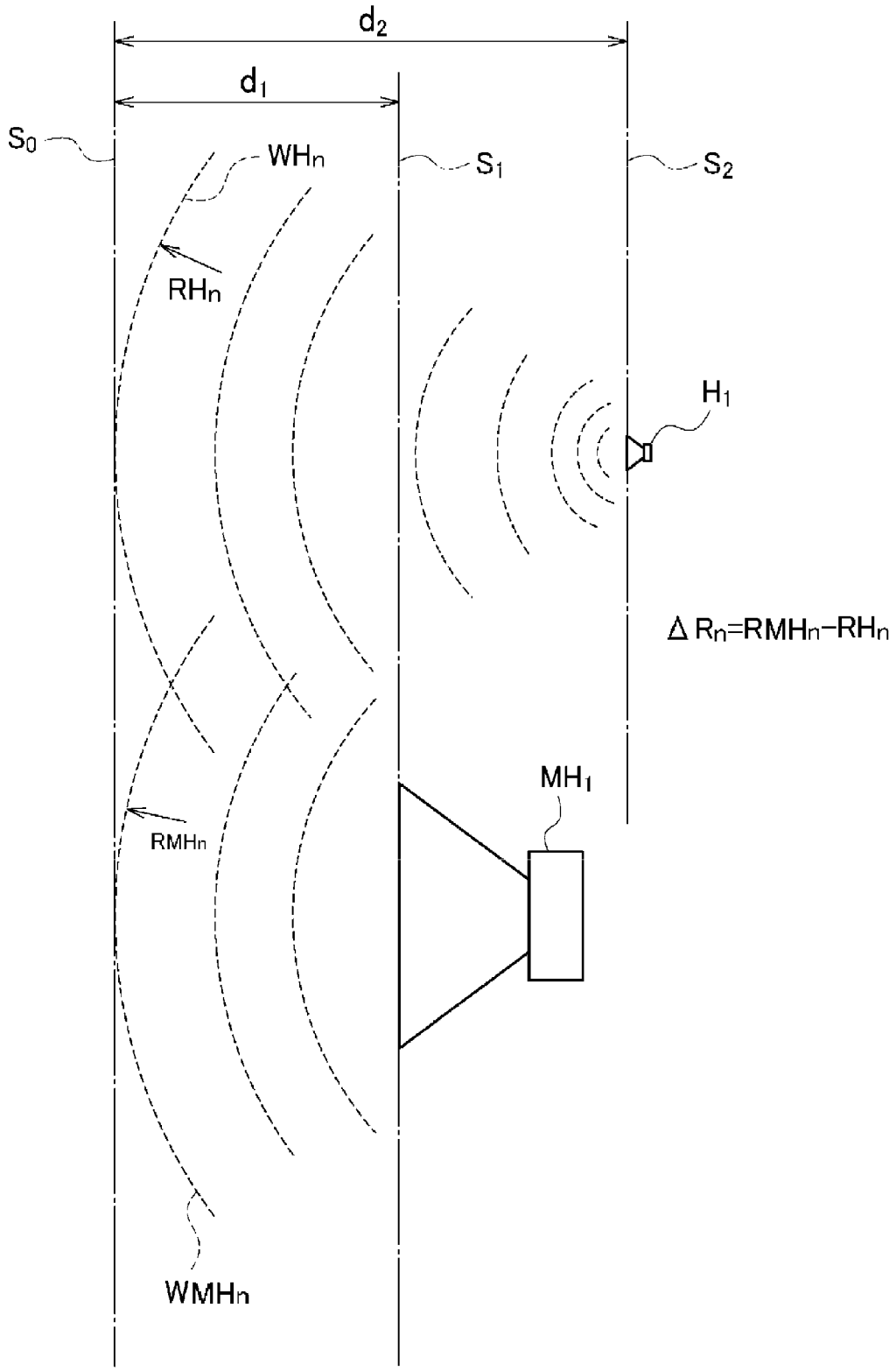
FIG. 8 is an explanatory view of a speaker device according to another embodiment of the present invention.

FIG. 8 is an explanatory view of a speaker device according to another embodiment of the present invention. As illustrated in FIG. 8, according to the speaker device of the present embodiment, it is possible to reduce a difference in the radius of curvature of the wavefront between the two units, by changing a front-back positional relationship between the speaker unit group having relatively large diameters and the speaker unit group having relatively small diameters. That is, the mid-high pitched speaker unit MH1 is placed on the surface S1 at a distance d1 from the reference surface S0, and the high-pitched speaker unit H1 is placed on the surface S2 at a distance d2 farther than distance d1 from the reference surface S0. Although the description of the speaker box and the like having such a configuration is omitted, the configuration is almost the same as that of the previous embodiment except for the difference in this configuration.

Regarding a relationship between d1 and d2, for example, a candidate value is determined temporarily by referring to a value of the difference in the diameter of both speaker units, actually by listening to the sound with that candidate value, increasing or decreasing the value, then, further listening to the sound. Then, an audibly optimum number is determined. For example, for a unit having a diameter of 5 cm and a unit having a diameter of 1 cm, first the relationship is set to d1=25 cm and d2=29 cm, then, listening is tried. Next, listening is tired, with only d2 set to 28 cm or 30 cm, to obtain a value that is most audibly preferable.

Figure 9:
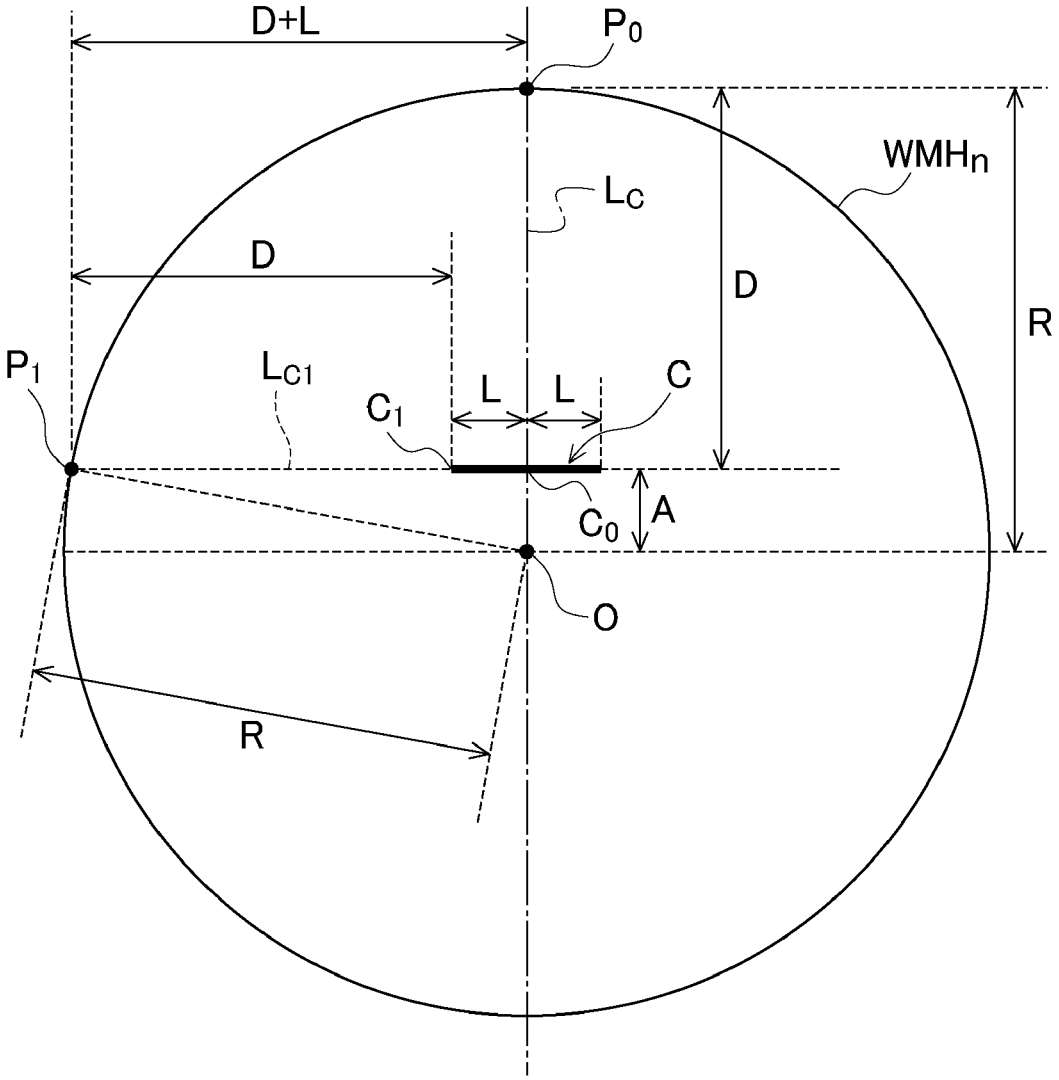

Further, when the virtual sound source point of the mid-high pitched speaker unit MH1 and the virtual sound source point of the high-pitched sound speaker unit H1 are known, the positional relationship between the two can be obtained more accurately. FIG. 9 is an explanatory view of a method for obtaining the virtual sound source point of the mid-high pitched speaker unit MH1 or the like. Here, a cone paper C, which is a diaphragm of this speaker unit, has a circular shape having a diameter of 2L. Further, a center point of this cone paper C is Co, and one end is C1. Then, it is assumed that the virtual sound source point O is located at a distance of A rearward from Co on a center line Lc passing through the center point Co.

Then, the wavefront WMHn of the sound output from the cone paper C is the wavefront of the sound output from the virtual sound source point O. That is, WMHn is a spherical surface having a radius R centered on the virtual sound source point O. Wherein, Po is a point where the center line Lc of the cone paper C intersects the wave front WMHn, and P1 is a point where a straight line Lc1 passing through the center point Co of the cone paper C and parallel to the cone paper C intersects the wave front WMHn. Then, since distances directed to P0 and P1 on the same wavefront are the same, CoP0 and C1P1 are the same distance D.

Then, in the triangle CoP1O, the relationship of (L+D) (L+D)+A×A=R×R is established.

Wherein, R=D+A. Therefore, (L+D) (L+D)+A× A=(D+A) (D+A) is established. Therefore, A=L+L× L+2D is established.

Figure 10:
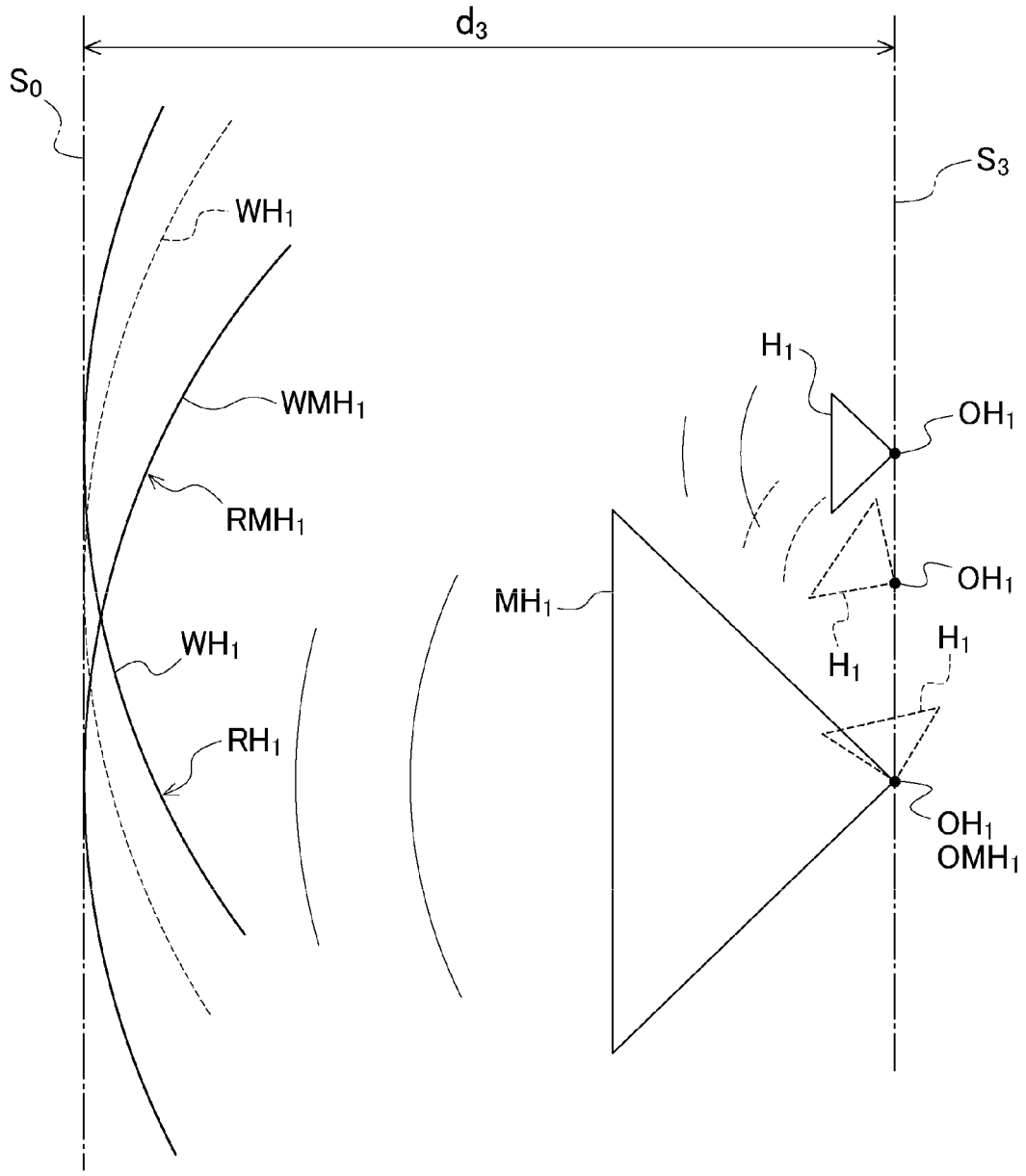
FIG. 10 is an explanatory view of a placement relationship between speaker units when a virtual sound source point OMH1 of a mid-high pitched speaker unit MH1 and a virtual sound source point OH1 of a high-pitched speaker unit H1 are obtained.

FIG. 10 is an explanatory view of a placement relationship between the speaker units when the virtual sound source point OMH1 of the mid-high pitched speaker unit MH1 and the virtual sound source point OH1 of the high-pitched speaker unit H1 are obtained. In this case, the mid-high pitched speaker unit MH1 is placed so that the virtual sound source point OMH1 of the mid-high pitched speaker unit MH1 rests on a surface S3 located at a distance d3 farther than d2 from the reference surface S0. Next, the speaker unit H1 is placed so that the virtual sound source point OH1 of the speaker unit H1 also rests on the surface S3. Thereby, the radius of curvature RMH1 of the wave front WMH1 of the sound output from the mid-high pitched speaker unit MH1 and the radius of curvature RH1 of the wave front WH1 of the sound output from the speaker unit H1 are the same.

According to an experiment by the present inventor, it has been confirmed that when the radius of curvature RMH1 and the radius of curvature RH1 are the same, the audible sound is remarkably improved. Then, further, when the virtual sound source point OMH1 of the mid-high pitched speaker unit MH1 and the virtual sound source point OH1 of the speaker unit H1 are moved on the surface S3 and become close to each other as shown by the dotted line in FIG. 10, it has been confirmed that the audible sound is further dramatically improved. Here, the fact that the virtual sound source points of the speaker units MH1 and H1 become close to each other means that the wavefronts approach each other after all. That is, it is considered that the closer the wavefronts are to each other, the better the audible sound. When the virtual sound source points of the two speakers completely overlap, the wavefronts of each other also completely overlap. Accordingly, this state is considered to be an ideal state. Therefore, it is desirable to get as close to the ideal state as the speaker placement allows.

Even in the present embodiment, almost the same effect as in the case of the previous embodiment can be obtained. However, in the case of the present embodiment, there is an advantage that the number of the speaker units used can be reduced, compared with the case of the previous embodiment. On the other hand, since a distance to a measurement microphone position at the time of correction differs for each speaker unit, certain ingenuity is required for channel divider setting and correction algorithm. However, by using a high-precision digital correction device equipped with tens of thousands or more FIR digital filters, even with a relatively ordinary algorithm, it is possible to extremely accurately correct a deviation of the time axis and a deviation of the frequency characteristics due to the difference in the distance of each speaker unit. In this respect, the previous embodiment is advantageous as compared with the present embodiment.

In the embodiment described above, an example of whether to select the relationship between the number of speaker units having large diameters and speaker units having small diameters, or whether to select the relationship between the placement distances, is given. However, it is a matter of course that the two methods may be combined. By doing so, it is possible to reduce the number of different speakers and at the same time reduce the number of speakers used.

As described in detail above, according to the audio device of the present invention, "creation of an ideal wavefront" has become possible, and more natural sound can be reproduced. Further, according to the audio device of the present invention, an ideal correction can be applied, thereby enabling "waveform reproduction" for the music waveform engraved on the source. Further, according to the audio device of the present invention, since "ideal wavefront creation" and "waveform reproduction" can be realized at the same time, a revolutionary reproduced sound having a different dimension from the reproduced sound of a conventional audio device can be obtained.

DESCRIPTION OF SIGNS AND NUMERALS

3 Digital channel divider
4 Preamplifier with sound field correction function
5 Sound source
10 Speaker device
11 Low-pitched speaker unit group
12 Mid-low pitched speaker unit group
13 Mid-high pitched speaker unit group
14 High-pitched speaker unit group
21 Low-pitched amplifier
22 Mid-low pitched amplifier
23 Mid-high pitched amplifier
24 High-pitched amplifier
101 Box member
102 Vibration control sheet
103 Sound absorbing member
104 Sound absorbing panel

The invention claimed is:

1. A speaker device comprising:

a plurality of speaker unit groups, each speaker unit group comprising one or more speaker units, wherein each of the speaker unit groups is a multi-way speaker device that allows one or more of the speaker units to be regarded as a unit that virtually outputs sound in a frequency range that one speaker handles, and a reproduction frequency range is divided into a plurality of frequency ranges, and a reproduction of each frequency range is handled by a speaker unit group of the plurality of speaker unit groups;

a first speaker unit group, of the plurality of speaker unit groups, that handles a relatively low frequency range, the first speaker unit group comprising speaker units having relatively large diameters; and a second speaker unit group, of the plurality of speaker unit groups, that handles a relatively high frequency range, the second speaker unit group comprising speaker units having relatively small diameters, wherein based on a recognition that a wavefront of the sound output from the speaker unit group is approximated to a spherical surface centered on a virtual sound source point of each speaker unit group, and an ideal state is when virtual sound source points of each speaker unit group overlap and the spherical surface of the wavefront of the sound output from each speaker unit group overlaps one spherical surface, in order for the virtual sound source points of each speaker unit group to be close to each other so that the wavefront of the sound output from each speaker unit group is approximated to one spherical surface, a placement position of the speaker unit group having relatively small diameters that output relatively high frequency sound is set at AL-AH distance rearward from a listening position with respect to a placement position of the speaker unit group having relatively large diameters that output relatively low frequency sound, AL is a distance from a diaphragm to the virtual sound source point when the diaphragm of the speaker unit group having relatively large diameters that output relatively low frequency sound is approximated to one circular diaphragm, and AH is a distance from the diaphragm to the virtual sound source point when the diaphragm of the speaker unit group having relatively small diameters that output relatively high frequency sound is approximated to one circular diaphragm.

2. The speaker device according to claim 1, wherein the speaker unit groups are placed so that the virtual sound source points of each of the speaker unit groups are on a common plane.

3. The speaker device according to claim 1, wherein when a diaphragm of the speaker unit or the speaker unit group is approximated to one circle, and a diameter of the circle is 2L, a distance between the wavefront of the sound output from the unit and the diaphragm is D, and a position of the virtual sound source point is at a distance A rearward from the diaphragm on a central axis of the diaphragm, the virtual sound source point of each speaker unit or speaker unit group is obtained by a formula, with a value of A set as $A=L+(L\times L\div 2D)$.

4. The speaker device according to claim 1, wherein the speaker units constituting the speaker unit group that handles each frequency range can handle a sound in this frequency range by themselves, and in the frequency range that each single speaker unit handles, a sound in the frequency range that is handled by each single speaker unit, is outputted by a piston movement so that cone paper does not cause split vibration.

5. The speaker device according to claim 1, wherein a sound absorbing member for absorbing noise generated from a surface of a speaker box to which the speaker unit is attached, is provided on a main surface of the speaker box.

6. An audio device, comprising:

a channel divider device that divides an input sound signal into multiple frequency ranges and outputs it;

a plurality of amplification devices that input sound signals output from the channel divider device, amplify them, and output them;

a multi-way speaker device that inputs the outputs of the plurality of amplification devices to different speaker units that handle reproduction in each frequency range and reproduces them, and a digital correction device that corrects group delay characteristics and frequency characteristics of the audio device, wherein the speaker device is the speaker device according to claim 1.

7. The audio device according to claim 6, wherein the digital correction device has a correction algorithm created based on impulse response characteristics obtained by placing a measurement microphone at a measurement position installed in a range of 10 cm to 100 cm from the speaker device, and this correction algorithm is an algorithm that corrects frequency characteristics and group delay characteristics so that the frequency characteristics and the group delay characteristics become almost ideal characteristics in a reproduction frequency range planned by this audio device, accordingly, when this audio device records music on a source such as a CD, reproduces the music, detects and records sound that is reproduced with a microphone installed at the measurement position, and a recorded music waveform is compared with a music waveform recorded on a source such as an original CD, both waveforms almost match.

* * * * *